US009042563B1

(12) United States Patent
Beaty et al.

(10) Patent No.: US 9,042,563 B1
(45) Date of Patent: May 26, 2015

(54) SYSTEM AND METHOD TO LOCALIZE SOUND AND PROVIDE REAL-TIME WORLD COORDINATES WITH COMMUNICATION

(71) Applicant: John Beaty, New York, NY (US)

(72) Inventors: John Beaty, New York, NY (US); Jamaal Sawyer, Astoria, NY (US)

(73) Assignee: John Beaty, New York, NY (US)

( * ) Notice: Subject to any disclaimer, the term of this patent is extended or adjusted under 35 U.S.C. 154(b) by 0 days.

(21) Appl. No.: 14/251,412

(22) Filed: Apr. 11, 2014

(51) Int. Cl.
*H04R 29/00* (2006.01)

(52) U.S. Cl.
CPC ..... *H04R 29/00* (2013.01)

(58) Field of Classification Search
CPC ..... H04R 29/00; H04S 7/30; H04S 7/40; H04S 7/305; H04S 7/302
USPC ..... 381/56–58, 300, 17; 700/94; 348/143, 348/578, 14.1
See application file for complete search history.

(56) References Cited

U.S. PATENT DOCUMENTS

| | | | | |
|---|---|---|---|---|
| 4,737,001 | A | 4/1988 | Moss | |
| 5,335,011 | A | 8/1994 | Addeo et al. | |
| 8,396,226 | B2 | 3/2013 | KnicKrehm et al. | |
| 8,416,957 | B2 | 4/2013 | Tsujino et al. | |
| 2002/0181721 | A1 * | 12/2002 | Sugiyama et al. | 381/92 |
| 2004/0151066 | A1 | 8/2004 | Kim et al. | |
| 2006/0156906 | A1 | 7/2006 | Haeker | |
| 2006/0206221 | A1 | 9/2006 | Metcalf | |
| 2009/0052677 | A1 | 2/2009 | Smith | |
| 2009/0123007 | A1 | 5/2009 | Katayama | |
| 2010/0110164 | A1 | 5/2010 | Kubara | |
| 2010/0150359 | A1 | 6/2010 | KnicKrehm et al. | |
| 2010/0171743 | A1 | 7/2010 | Hata | |
| 2010/0185308 | A1 | 7/2010 | Yoshida et al. | |
| 2010/0188929 | A1 | 7/2010 | Kitaura | |
| 2010/0189271 | A1 | 7/2010 | Tsujino et al. | |
| 2010/0272286 | A1 | 10/2010 | Bai et al. | |
| 2011/0081024 | A1 | 4/2011 | Soulodre | |
| 2011/0120222 | A1 | 5/2011 | Scholte et al. | |
| 2011/0317522 | A1 | 12/2011 | Florencio et al. | |
| 2012/0014528 | A1 | 1/2012 | Wang | |
| 2012/0075336 | A1 * | 3/2012 | Oda | 345/629 |
| 2012/0327746 | A1 * | 12/2012 | Velusamy | 367/127 |
| 2013/0016286 | A1 | 1/2013 | Nomura et al. | |
| 2013/0120569 | A1 | 5/2013 | Mizuta | |
| 2013/0147835 | A1 | 6/2013 | Lee et al. | |
| 2013/0163382 | A1 | 6/2013 | Millar et al. | |

OTHER PUBLICATIONS

PCT International Search Report and Written Opinion of the International Searching Authority issued Jun. 28, 2013, Application No. PCT/US2013/028866 (5227PCT).

* cited by examiner

*Primary Examiner* — Vivian Chin
*Assistant Examiner* — Ammar Hamid
(74) *Attorney, Agent, or Firm* — Sawyer Law Group, P.C.

(57) ABSTRACT

A system, method and program product for improved techniques for sound management and sound localization is provided. The present invention provides for improving sound localization and detection by inputting a predetermined location's dimensional data and location reference and processing detected sound details, detection device details and the associated location dimensional data as sound localization information for multi-dimensional display. The present invention provides mapping information of sound, people and structural information for use in multiple applications including residential, commercial and emergency situations.

20 Claims, 3 Drawing Sheets

200

100

200

SYSTEM AND METHOD TO LOCALIZE SOUND AND PROVIDE REAL-TIME WORLD COORDINATES WITH COMMUNICATION

CROSS REFERENCE TO RELATED APPLICATION

The present application is related to U.S. application Ser. No. 14/162,355, entitled "SYSTEM AND METHOD FOR MAPPING AND DISPLAYING AUDIO SOURCE LOCATIONS", filed on Jan. 23, 2014, and U.S. application Ser. No. 13/782,402, entitled "SYSTEM AND METHOD FOR MAPPING AND DISPLAYING AUDIO SOURCE LOCATIONS", filed on Mar. 1, 2013, to be issued on Apr. 22, 2014 as U.S. Pat. No. 8,704,070, all of which are invented by the same inventors as the present application and incorporated herein by reference in their entireties.

FIELD OF THE INVENTION

The present invention relates generally to the field of sound management and sound localization involving locating sound sources in one or more defined area. More particularly, the present invention relates to methods and arrangements for improved techniques for sound management and sound localization, and providing for the specifics of a predetermined location's physical layout, a listener's static or dynamic location, and also for differentiation as between electronically-generated sound and human sound (e.g., vocal emanations, talking, etc.).

BACKGROUND

There are numerous implementations to using microphones in predefined areas to improve sound quality. For instance, residential entertainment systems employ a central microphone to listen for each speaker arranged in a room by a residential user when the entertainment system is first implemented; in such a system, the microphone listens for sounds from each speaker and a processor determines an approximate physical arrangement. From the determined arrangement, the entertainment system adjusts output characteristics for each speaker such that an optimized sound quality can be experienced by the user at a predetermined location, typically that of where the microphone is placed during testing. Other systems may employ an array of microphones (directional, omnidirectional, etc.) to achieve a similar result in a more complex setting.

While microphones may be designed and utilized in arrangements to approximate physical locations of speakers in a predetermined area, the precise location of each speaker is often difficult to obtain. Further, because a predetermined area is often more complex than a simple box arrangement, many factors and characteristics about the predetermined area are often not known or accounted for in the determination of speaker locations. For instance, few locations, such as rooms or arenas, have a specific or pure geometric configuration; often there are cut-outs, heating and ventilation encumbrances, and other structural inclusions that can impact the transmission of sound waves across and throughout the area. This typically may also result in human error of speaker placement or may result in a contractor's placing speakers in locations that may be more convenient for structural placement than for sound quality. Additionally, often these systems result in a single preferred point of sound quality which can be limiting to multi-users in larger venues, residential situations where the furniture layout is modified, and even situations where the listener moves within a room, for instance. Further, these systems typically account for sound waves associated with the electronic sound generated from the system.

Therefore it is desired to have an improved technique for sound localization that provides for the specifics of a predetermined location's physical layout, a listener's static or dynamic location, and also for differentiation as between electronically-generated sound and human sound (e.g., vocal emanations, talking, etc.). Further, it is desired to have such an improved technique that additionally provides for identifying one or more person's presence in a predetermined area using voice recognition technology. The present invention addresses such needs.

SUMMARY

The present invention fulfills these needs and has been developed in response to the present state of the art, and in particular, in response to the problems and needs in the art that have not yet been fully solved by currently available technologies.

One embodiment of the present invention provides for A method for improving sound localization and detection, comprising: inputting a predetermined location's dimensional data and location reference data for one or more detection devices in the predetermined location; identifying a sound detected by the one or more detection devices; and, providing sound localization information to one or more receiving sources; wherein sound localization information includes position and location information in relation to the one or more detection devices and the detected sound in association with the predetermined location's dimensional data.

Another embodiment of the present invention provides for A computer program product stored on a computer usable medium, comprising: a computer readable program means for causing a computer to control an execution of an application to perform a method for improving sound localization and detection including: inputting a predetermined location's dimensional data and location reference data for one or more detection devices in the predetermined location; identifying one or more sounds detected by the one or more detection devices; and, providing sound localization information to one or more users;

A further embodiment provides for a system for improving sound localization: comprising one or more detection devices arranged in a predetermined location directly associated with a physical dimensional representation of the location, one or more processors for processing detecting one or more sounds in the predetermined location in relation to reference sound characteristics and for mapping the detected one or more sounds in relation to the predetermined location's dimensional data for display; one or more detection devices in communication with the one or more processors; an analyzer that correlates a time difference of arrival of a detected sound and a reflected sound; and a communication interface for providing sound localization information for display.

As used herein, the term microphone is intended to include one or more microphones which may include an array.

Other aspects and advantages of the present invention will become apparent from the following detailed description, taken in conjunction with the accompanying drawings, illustrating by way of example the principles of the invention.

DETAILED DESCRIPTION OF PREFERRED EMBODIMENTS

The present invention relates generally to the methods and arrangements for improved techniques for sound localization that provides for the specifics of a predetermined location's physical layout, a listener's static or dynamic location, and also for differentiation as between electronically-generated sound and human sound. The determination and processing, as used herein, may include the use and application of voice recognition technology and software. The present invention further provides for identifying one or more person's presence in a predetermined area using voice recognition technology.

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
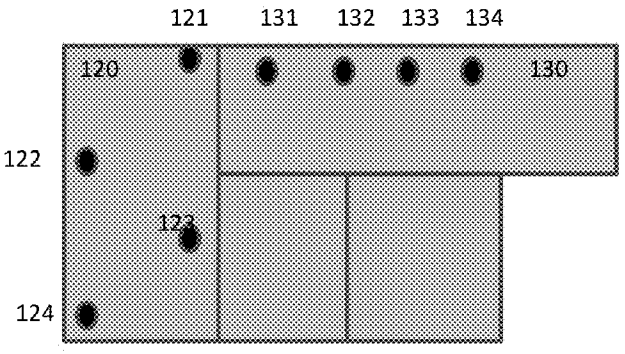
FIG. 1 presents a typical arrangement of a predetermined area, such as a room in a residence.

FIG. 1 presents a typical arrangement 100 of a predetermined area 110, such as a room in a residence. The room's physical dimensions may be determined from actual measurement or, more preferably, from an architectural rendering or blueprint in which the room is being or has been built to. Often, where a predetermined area's configuration has some complexity associated with it, a blueprint is preferred as a blueprint typically will also include details of construction, materials, other infrastructural systems (i.e., electrical, water, etc.), and other aspects which may affect sound quality within a predetermined area.

In one or more embodiments of the present invention, a determination is made from the blueprints as to where sound detection, monitoring, and/or emanation is sought. For instance, from FIG. 1, sound is desired to be monitored in the room identified at 120 since this is identified as an infant's room. Similarly, from FIG. 1, sound is also desired to be a focal point at 130, the living room, where it is desired to have an optimal quality of sound from the entertainment system. At 120 and 130, it is also desired to recognize that there will be human voices in these rooms as well as electronic sounds and to be able to differentiate between the two types.

Microphones are placed in each room that is desired to have sound detection, monitoring and/or emanation associated with it. It will be readily recognized that it may be advantageous to place one or more microphones in each room identified on a blueprint, depending on the specific need or situation. The placement of the microphones are then determined where each microphone's 2-D and 3-D coordinates are actually determined by physically measurement or virtually determined via one or more associated processors detection of sound waves transmitted for receipt by the microphones, in relation to each respective microphone. These determined locations of each microphone are directly associated with the blueprints such that each microphone has a set of blueprint coordinates associated with it.

From FIG. 1, a microphone array is placed at 121-124 in room 120, and at 131-134 for room 130, though a system and method in accordance with the present invention is neither so limited to nor dependent upon this exemplary depiction. Each of the placed microphones has a blueprint coordinate (X,Y,Z) associated with it and placed into a database associated with therewith.

From FIG. 1, in operation, a system and method in accordance with the present invention in one or more embodiments will typically utilize one or array of microphones in a predetermined location until there is a determination of a sound being detected or that there is a need to utilize a plurality of microphones. For instance, once a system and method in accordance with the present invention is operational, in room 120, it may be determined that only microphone 121 is active and on, while microphones 122-124 remain passive. However, upon the occurrence of detecting a sound, such as a non-human generated sound, the a system and method in accordance with the present invention may immediately activate microphones 122-124 such that they are active, may determine where the detected sound is located by one or more microphones, and may transmit the determined information to a receiving source.

Figure 2:
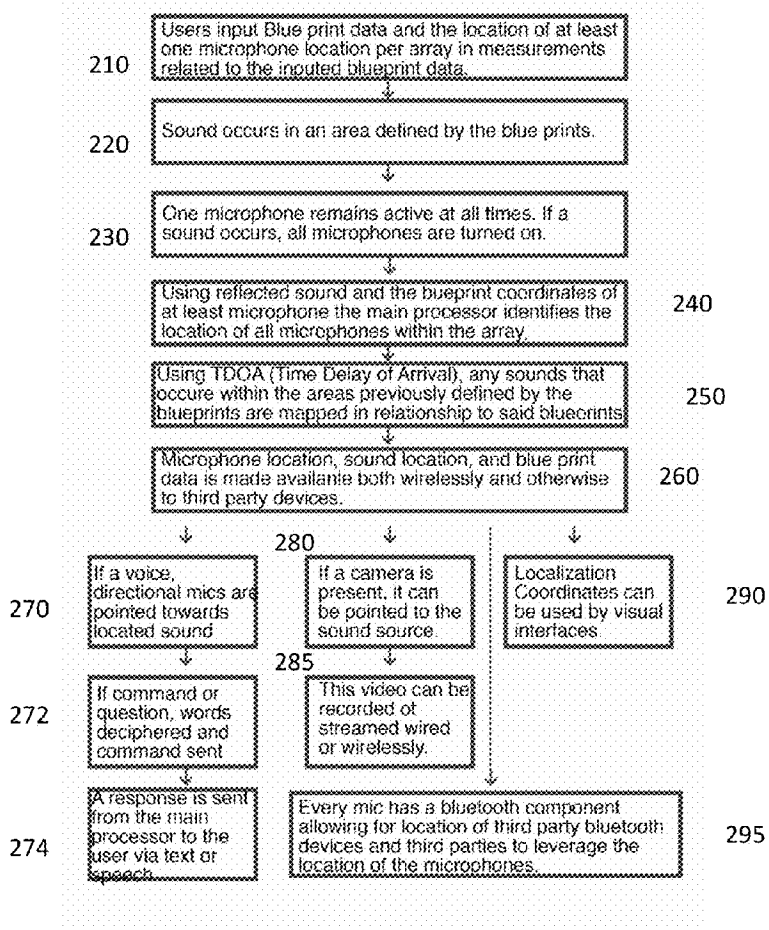
FIG. 2 sets forth a flowchart for the operation of a system and method in accordance with the present invention in accordance with one or more embodiments.

FIG. 2 sets forth a flowchart 200 for the operation of a system and method in accordance with the present invention in accordance with one or more embodiments of the present invention.

From FIG. 2, the blueprint data of one or more predetermined locations along with the location data of at least one microphone, associated with the blueprint data, is provided at 210. Preferably, the data associating the blueprint dimensions and the microphone location is stored in a database that is accessible by a system and method in accordance with the present invention. At 220, a system and method in accordance with the present invention provides for detecting one or more sounds by one or more active microphones in a predetermined location. At 230, upon the detection of a sound by an active microphone, if there are passive or non-active microphones also in the predetermined area, those passive or non-active microphones are also all turned on. Preferably, a system and method in accordance with the present invention may activate passive or non-active detection devices (microphones, camera, actuators, etc.) via a communication command which may be direct, indirect or remote, and may include a central server, a central processing unit (CPU), a computer, or other device enabling the transmission of a data signal to the passive or non-active device to turn on. Operationally, by having a single active microphones, power consumption and resource demands may be reduced via a system and method in accordance with the present invention.

At 240, a system and method in accordance with the present invention then determines the location of all microphones within the array in the predetermined location using reflected sound determination techniques and the blueprint coordinates of at least one microphone in the predetermined area. Preferably, using reflected sound to measure the difference in time between the sound detected and reflected sound at each active microphone provides for the processing by a system and method in accordance with the present invention to determine the X, Y and Z coordinates of the microphones in a predetermined location. Preferably, a system and method in accordance with the present invention determines the location of all microphones at 240 using the data previously stored from the blueprint and microphone locations as well as via reflected sound techniques; operationally this approach is advantageous as often only a single microphone's location may be precisely known or microphones (and other detection devices) may be moved from time to time for convenience.

At 250, a system and method in accordance with the present invention maps one or more detected sounds in relation to the blueprint data for the predetermined location, using time delay of arrival (TDOA) techniques. At 260, a system and method in accordance with the present invention provides information determined to a receiving source through a communication mechanism such as a wireless communication system or via a wired system. A system and method in accordance with the present invention is not limited to a particular manner of communicating the determined information to a receiving source.

At 260, a system and method in accordance with the present invention has already determined what sound and type of sound has been determined (i.e., human, electronically-generated, etc.). Preferably the determination of the type of sound, as human or non-human, is determined by a system and method in accordance with the present invention comparing sound characteristics to the sound(s) detected by the one or microphones in which a determination of the sound being electronically-generated or not electronically-generated can be readily determined.

At 270, where a voice sound has been detected, a system and method in accordance with the present invention arranges directional microphones which may be present in the predetermined location to be focused towards the detected sound. At 272, a system and method in accordance with the present invention further determines, and may additional detect additional sounds, whether the detected sound is a command or is associated with the form of question, based on characteristics of the detected sound. For instance, a command may include, but not be limited to, words such as ON, OFF, OPEN, CLOSE, etc., and may be in any language. The commands, general or specific, may be part of a database which is readily accessible by a system and method in accordance with the present invention. Similarly, vocal patterns may be part of a database accessible by a system and method in accordance with the present invention in which voice sounds detected may be determined by a system and method in accordance with the present invention to form a question in which a response is being sought. A system and method in accordance with the present invention, in one or more preferred embodiments, may also include the capability to directly or indirectly provide an answer to the question in the form of an action, a text, a provision of a webpage or link, an electronically-generated response, or similar, at 274; additionally, a system and method in accordance with the present invention may be able to refer the question to a secondary source, such as a smartphone having a voice-activated operating system, so the secondary source can be responsive to the question.

In a preferred embodiment, a system and method in accordance with the present invention includes cameras and actuation devices (locks, motors, on/off switches, etc.) which are also present in the predetermined location and each have a blueprint coordinate set associated with them. At 280, after the detection of a sound is identified, an actuation device can be initiated to be actuated in response to the sound detected, such as turning a camera towards the sound source and activating the camera to provide, record, transmit, and otherwise provide imagery at 282, wirelessly or wired.

At 290, following the mapping of the information detected by a system and method in accordance with the present invention, the localization coordinates can be utilized by visual interfaces. For instance in one or more embodiments, once a sound is detected and the information is mapped, a mapping of a specific room and the location of the detection devices (microphones, cameras, etc.) may be sent to a user on a smartphone or via a URL link for access, where a user can view the activating and make appropriate decisions based on the information received.

At 295, in one or more preferred embodiments, the detection device may include send, receive, transceiver capabilities. These capabilities may include but not be limited to Bluetooth for instance, where one or more detection devices in the predetermined location may further detect other connectable devices such that these other connectable devices may be connected to a system and method in accordance with the present invention and their features, characteristics and data gathering capabilities may also be used and/or integrated into a system and method in accordance with the present invention to further assist in sound detection, sound identification, sound localization, sound management, communications and dissemination.

A system and method in accordance with the present invention is also suited for rescue and emergency situations involving the safety of human life. For instance, an injured person in a predetermined location may call out within a specific room. The injured person's calling out is detected as human voice by a system and method in accordance with the present invention. In response to the call out by the injured person, the system may then communicate with the appropriate receiving source (user, emergency contact, police, computer, etc.) to communicate the information and/or the mapping of the information determined. In response, the receiving source can then act upon the information received.

Similarly, upon the occurrence of a fire, for instance, responding emergency personnel may receive a mapping of information in which coordinate sets of persons remaining in the building are identified and associated with their specific location in the residence or building. Additionally, whether a detected person is upright or in a downward location may also be determined as the three dimensional coordinate information is available for each person. Such information may assist emergency personnel is prioritizing a plan of action in response.

A system and method in accordance with the present invention provides processing, via one or more processors, to detect and determine one or more sounds from one or detection devices in communication with the one or more processors. The processing, in one or more preferred embodiments also provides for noise cancellation techniques and the cancelling of reflected sounds and white noise that are not a target of detection. The one or more processors may also be in communication with one or more connectable devices as well and is envisioned to be integrated with smart homes, intelligent systems and the like.

It will be appreciated that a system and method in accordance with the present invention may be integrated and adapted to work with a method for defining a reference sound position and producing an indicia proximate thereto in relation to one or more sound characteristics at a predetermined location, such as that disclosed in the related U.S. application Ser. No. 13/782,402, entitled "System and Method for Mapping and Displaying Audio Source Locations". Preferably, the combined method includes: defining at least one sound characteristic to be detected; detecting at least one target sound in relation to the at least one sound characteristic; and determining the referenced sound position in relation to the detected target sound, associating the detected sound with the predetermined location's dimensional details and displaying the detected one or more sounds in relation to the predetermined location's dimensions.

Figure 3:
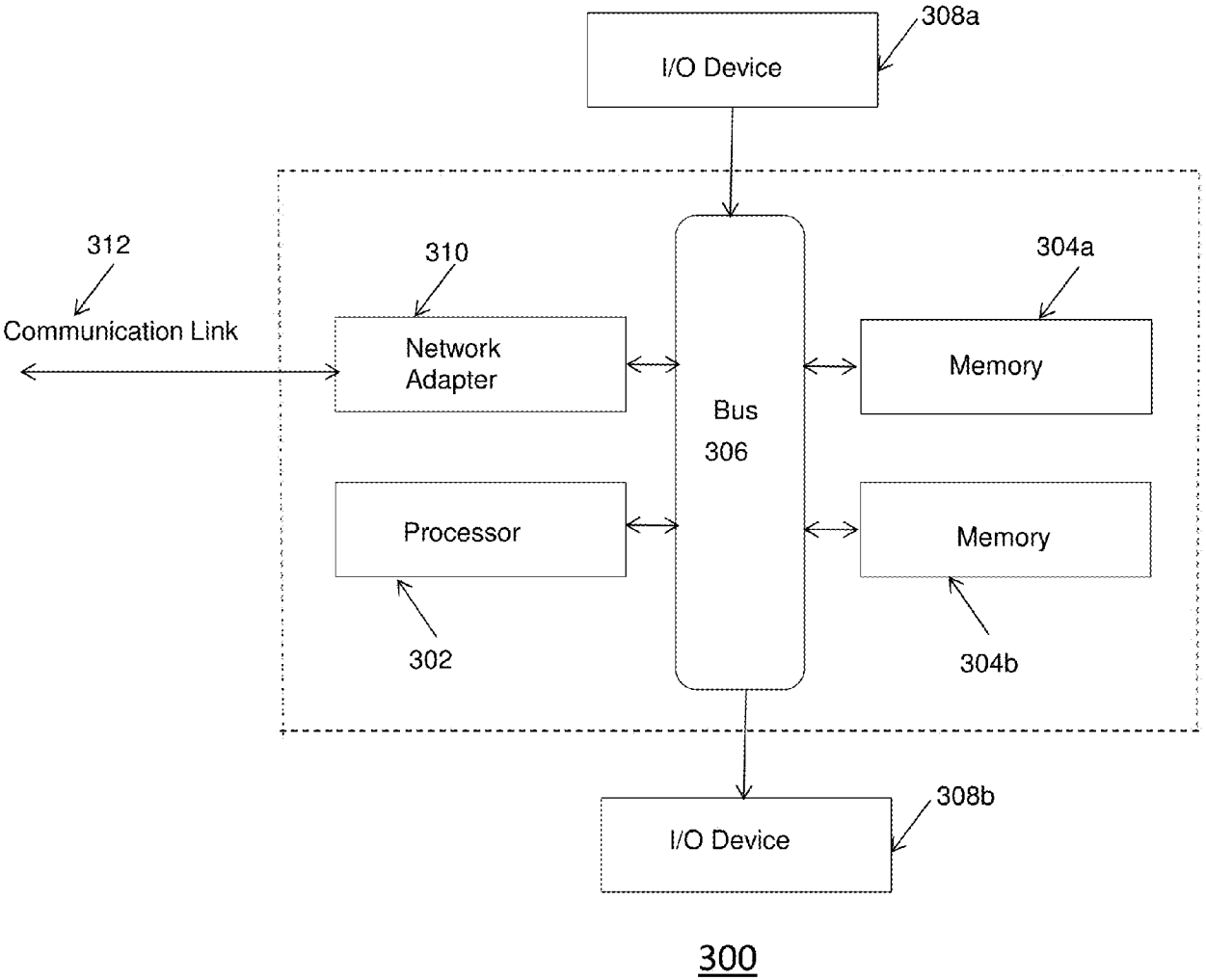
FIG. 3 illustrates a data processing system suitable for storing the computer program product and/or executing program code in accordance with one or more embodiments of the present invention.

FIG. 3 illustrates a data processing system 300 suitable for storing the computer program product and/or executing program code in accordance with one or more embodiments of the present invention. The data processing system 300 includes a processor 302 coupled to memory elements 304*a-b* through a system bus 306. In other embodiments, the data processing system 300 may include more than one processor and each processor may be coupled directly or indirectly to one or more memory elements through a system bus.

Memory elements 304*a-b* can include local memory employed during actual execution of the program code, bulk storage, and cache memories that provide temporary storage of at least some program code in order to reduce the number of times the code must be retrieved from bulk storage during execution. As shown, input/output or I/O devices 308*a-b* (including, but not limited to, keyboards, displays, pointing devices, etc.) are coupled to the data processing system 300. I/O devices 308*a-b* may be coupled to the data processing system 300 directly or indirectly through intervening I/O controllers (not shown).

Further, in FIG. 3, a network adapter 310 is coupled to the data processing system 302 to enable data processing system 300 to become coupled to other data processing systems or remote printers or storage devices through communication link 312. Communication link 312 can be a private or public network. Modems, cable modems, and Ethernet cards are just a few of the currently available types of network adapters.

Additionally, in one or more preferred embodiments, the data processing system 300 of FIG. 3 may further include logic and controllers suitable for executing program code in accordance with one or more embodiments of the present invention.

For instance, the data processing system 300 may include a plurality of processors at 302, wherein each processor may pre-process, process or post-process data (such as but not limited to detection device information, data and sensor data) that is received or transmitted in relation to the detection devices, the connectable devices and other data gathering devices in relation to the predetermined location and association with sound detection of a system and method in accordance with the present invention.

The plurality of processors may be coupled to memory elements 304*a-b* through a system bus 306, in respect to their processing with a system and method in accordance with the present invention. A plurality of input/output or I/O devices 308*a-b* may be coupled to the data processing system 300 directly, in association with a respective processor, or indirectly through intervening I/O controllers (not shown). Examples of such I/O devices may include but not be limited to microphones, microphone arrays, acoustic cameras, sound detection equipment, light detection equipment, actuation devices, smartphones, sensor-based devices, etc.

In one or more preferred embodiments, software operative for a system and method in accordance with the present invention may be an application, remote software or operable on a computer, smartphone, or other computer-based device. For instance, sound detected from a sound source such as a detection device (e.g., microphone array) may be used with a system and method in accordance with the present invention where software of the invention is arranged to detect sound sources from the detection devices, determine the type of sound detected, activate other detection devices, determine the detected sound or sounds location in relation to the dimensional data of the predetermined location, and provide the processed determinations as sound localization information that is available as text, hyperlink, web-based, three-dimensional or two-dimensional imagery, etc. A system and method in accordance with the present invention is capable of providing the visual image, including the mapping of the sound localization details, to a remote device or via a linked display, in accordance with one or more embodiments of the present invention. It is envisioned that the present device may be used in most any environment and application including those involving but not limited to entertainment, residential use, commercial use, emergency and governmental applications, interactive electronic and virtual forums, homeland security needs, etc.

In a further arrangement, an acoustic camera and video cameras may be used as additional detection devices or as connectable devices.

The system, program product and method provides for improved sound localization that provides for the specifics of a predetermined location's physical layout, a listener's static or dynamic location, and also for differentiation as between electronically-generated sound and human sound. A system and method in accordance with the present invention further provides for identifying one or more person's presence in a predetermined area using voice recognition technology.

In the described embodiments, the system and method may include any circuit, software, process and/or method, including an improvement to an existing software program, for instance.

Although the present invention has been described in accordance with the embodiments shown, one of ordinary skill in the art will readily recognize that there could be variations to the embodiments and those variations would be within the spirit and scope of the present invention, such as the inclusion of circuits, electronic devices, control systems, and other electronic and processing equipment. Accordingly, many modifications may be made by one of ordinary skill in the art without departing from the spirit and scope of the appended claims. Many other embodiments of the present invention are also envisioned.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

What is claimed is:

1. A method for improving sound localization and detection, comprising: inputting a predetermined location's dimensional data within a room and location reference data for one or more detection devices in the predetermined location; identifying a sound detected by the one or more detection devices; wherein each of the one or more detection devices have X, Y and Z blueprint coordinates associate therewith; wherein each of the one or more detection devices' two dimensional (2-D) and three dimensional (3-D) coordinates are actually determined by physical measurement of the one or more detection devices in relation to the room and virtually determined via one or more associated processors detecting sound waves transmitted for receipt by the one or more detection devices, in relation to each respective detection device; providing sound localization information to one or more receiving sources; mapping one or more detected sound locations in relation to the predetermined location's dimensional data; and transmitting the mapping to a receiving source and providing a visual display of the one or more detected sound locations and the predetermined location's dimensional data; wherein sound localization information includes position and location information in relation to the one or more detection devices and the detected sound in association with the predetermined location's dimensional data.

2. The method of claim 1, wherein the one or more detection devices includes a microphone, a camera, a sensor device, and a smartphone.

3. The method of claim 2, wherein the microphone is an array of microphones.

4. The method of claim 2, wherein the microphone is one or more of directional, omnidirectional, and adjustable to be pointed towards a target source of sound.

5. The method of claim 1, further including determining a categorical type of detected sound as one of being electronically-generated, physical noise, or human sourced.

6. The method of claim 5, further including activating one or more passive detection devices in the predetermined location to be active upon the detection of a sound by the one or more detection devices.

7. The method of claim 6, further including identifying the location of each of the one or more detection devices in the predetermined location.

8. The method of claim 7, wherein for each microphone present in the predetermined location, a location of each microphone is determined by processing reflected sound inputs in relation to the predetermined location's dimensional data.

9. The method of claim 7, further including mapping one or more detected sound locations in relation to the predetermined location's dimensional data.

10. The method of claim 9, further including transmitting the mapping to a receiving source and providing a visual display of the one or more one or more detected sound locations and the predetermined location's dimensional data.

11. The method of claim 10, wherein the mapping transmitted is one of a two-dimensional or three-dimensional representation.

12. A non-transitory computer program product comprises a computer usable medium, a computer readable program means for causing a computer to control an execution of an application to perform a method for improving sound localization and detection including: inputting a predetermined location's dimensional data within a room and location reference data for one or more detection devices in the predetermined location; identifying one or more sounds detected by the one or more detection devices; wherein each of the one or more detection devices have X, Y and Z blueprint coordinates associated therewith; wherein each of the one or more detection devices' two dimensional (2-D) and three dimensional (3-D) coordinates are actually determined by physical measurement of the one or more detection devices in relation to the room and virtually determined via one or more associated processors detecting sound waves transmitted for receipt by the one or more detection devices, in relation to each respective detection device; providing sound localization information to one or more users; mapping one or more detected sound locations in relation to the predetermined location's dimensional data; and transmitting the mapping to a receiving source and providing a visual display of the one or more detected sound locations and the predetermined location's dimensional data; wherein sound localization information includes position and location information in relation to the one or more detection devices and the one or more detected sounds in association with the predetermined location's dimensional data.

13. The non-transitory computer program product of claim 12, further including activating one or more passive detection devices in the predetermined location to be active upon the detection of a sound by the one or more detection devices.

14. The non-transitory computer program product of claim 13, further including mapping one or more detected sound locations in relation to the predetermined location's dimensional data.

15. The non-transitory computer program product of claim 14, further including transmitting the mapping to a receiving source and providing a visual display of the one or more one or more detected sound locations and the predetermined location's dimensional data.

16. The non-transitory computer program product of claim 15, wherein the receiving source is a user, a user's device, a computer, an apparatus capable of receiving a data signal through a communication link.

17. The non-transitory computer program product of claim 15 further including: defining at least one sound characteristic to be detected; detecting at least one target sound in relation to the at least one sound characteristic; and determining a sound position in relation to the detected target sound, associating the detected sound with the predetermined location's dimensional details and displaying the detected at least one sound in relation to the predetermined location's dimensions.

18. The non-transitory computer program product of claim 17, further including displaying in a multi-dimensional mode.

19. The non-transitory computer program product of claim 17, further including utilizing voice recognition detection to identify at least one of the one or more sounds as being from an electronic device, a human or a physical object in the predetermined location.

20. A system for improving sound localization: comprising one or more detection devices arranged in a predetermined location within a room directly associated with a physical dimensional representation of the location, one or more processors for processing detecting one or more sounds in the predetermined location in relation to reference sound characteristics and for mapping the detected one or more sounds in relation to the predetermined location's dimensional data for display; the one or more detection devices in communication with the one or more processors; wherein each of the one or more detection devices have X, Y and Z blueprint coordinates associated therewith; wherein each of the one or more detection devices' two dimensional (2-D) and three dimensional (3-D) coordinates are actually determined by physical measurement of the one or more detection devices in relation to the room and virtually determined via one or more associated processors detecting sound waves transmitted for receipt by the one or more detection devices, in relation to each respective detection device; an analyzer that correlates a time difference of arrival of a detected sound and a reflected sound; and a communication interface for providing sound localization information for display mapping one or more detected sound locations in relation to the predetermined location's dimensional data; and transmitting the mapping to a receiving source and providing a visual display of the one or more detected sound locations and the predetermined location's dimensional data.

* * * * *